US005458700A

United States Patent [19]

Masumoto et al.

[11] Patent Number: 5,458,700

[45] Date of Patent: Oct. 17, 1995

[54] HIGH-STRENGTH ALUMINUM ALLOY

[75] Inventors: Tsuyoshi Masumoto, 3-8-22, Kamisugi, Aoba-ku, Sendai-shi, Miyagi; Akihisa Inoue, 11-806, Kawauchijutaku, Mubanchi, Kawauchi Aoba-ku, Sendai-shi, Miyagi; Mitsuru Watanabe, Akita; Junichi Nagahora, Yokohama; Toshisuke Shitata, Kawasaki, all of Japan

[73] Assignees: Tsuyoshi Masumoto; Akihisa Inoue, both of Miyagi; Yoshida Kogyo K.K., Tokyo, all of Japan

[21] Appl. No.: 235,129

[22] Filed: Apr. 28, 1994

Related U.S. Application Data

[63] Continuation of Ser. No. 29,782, Mar. 11, 1993, abandoned.

[30] Foreign Application Priority Data

Mar. 18, 1992 [JP] Japan ..... 4062566

[51] Int. Cl.[6] ..... C22C 21/00

[52] U.S. Cl. ..... 148/403; 148/437; 420/528; 420/550; 420/551; 420/552; 420/553

[58] Field of Search ..... 148/403, 437; 420/528, 550, 551, 552, 553

[56] References Cited

FOREIGN PATENT DOCUMENTS

| | | |
|---|---|---|
| 049770 | 4/1982 | European Pat. Off. . |
| 136508 | 4/1985 | European Pat. Off. . |
| 208631 | 1/1987 | European Pat. Off. . |
| 460887 | 12/1991 | European Pat. Off. . |
| 475101 | 3/1992 | European Pat. Off. . |
| 3524276 | 1/1986 | Germany . |

*Primary Examiner*—David A. Simmons
*Assistant Examiner*—Robert R. Koehler
*Attorney, Agent, or Firm*—Flynn, Thiel, Boutell & Tanis

[57] ABSTRACT

A high-strength aluminum alloy consisting of an amorphous phase containing quasicrystals constituted of aluminum as the principal element, a first additive element consisting of at least one rare earth element and a second additive element consisting of at least one element other than aluminum and rare earth elements, and a crystalline phase consisting of the principal element and the first additive element and the second additive element contained in a supersaturated solid solution form, the amorphous phase containing quasicrystals being contained in a volume percentage of 60 to 90%. The contents of the additive elements preferably fall within a hatched range in the figure, still preferably within a range covered with dot-dash lines in the figure.

4 Claims, 1 Drawing Sheet

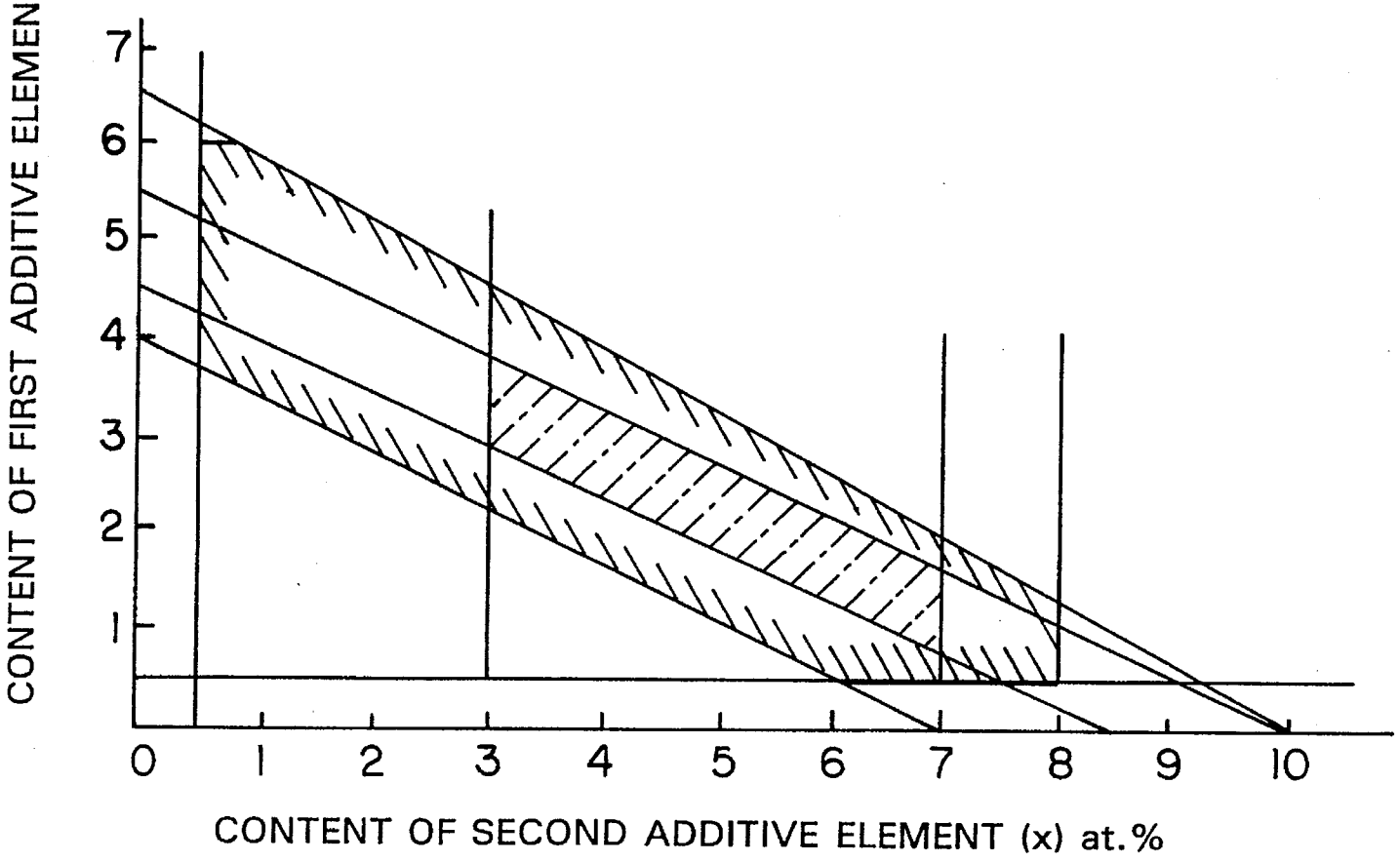
CONTENT OF FIRST ADDITIVE ELEMENT (y) at.%
7
6
5
4
3
2
1
0
1
2
3
4
5
6
7
8
9
10
CONTENT OF SECOND ADDITIVE ELEMENT (x) at.%

HIGH-STRENGTH ALUMINUM ALLOY

This application is a continuation of U.S. Ser. No. 08/029,782, filed Mar. 11, 1993, abandoned.

BACKGROUND OF THE INVENTION

1. Field of the Invention

The present invention relates to a high-strength aluminum alloy having an improved strength by surrounding a homogeneous fine amorphous phase in the network form by crystalline phase.

2. Description of the Prior Art

Japanese Patent Laid-Open Nos. 260037/1991 and 41654/1992 already disclosed high-strength aluminum alloys wherein an amorphous phase was present together with a crystalline phase. These alloys are high-strength alloys comprising an amorphous matrix and fine crystalline particles dispersed therein. In these alloys, however, the volume percentage of the crystalline phase is less than 40%, and there remains room for remedying the instability of the amorphous phase constituting the matrix and the brittleness inherent in that phase. Further, since they have a structure mainly composed of an amorphous phase, they unavoidably contain a large amount of additive elements comprising transition metals and rare earth elements, which gives rise to an increase in the density.

In conventional high-strength alloys consisting of an amorphous phase and crystalline particles dispersed therein, the total volume of the crystalline phase is up to 40% by volume with the major part of the balance consisting of an amorphous phase. In these alloys, the volume of the crystalline phase is limited to 40% or less because when it exceeds 40%, harmful intermetallic compounds are formed. In the present invention, quasicrystals, which are a kind of intermetallic compound, are finely dispersed in an amorphous phase to prevent the occurrence of other harmful intermetallic compounds in the crystalline phase, thereby providing a material having excellent toughness and strength.

SUMMARY OF THE INVENTION

The present invention provides a high-strength aluminum alloy consisting of an amorphous phase containing quasicrystals constituted of aluminum as a principal element, a first additive element consisting of at least one rare earth element and a second additive element consisting of at least one element other than aluminum and rare earth elements, and a crystalline phase consisting of the main element and the first additive element and the second additive element contained in the form of a saturated solid solution, wherein the amorphous phase containing quasicrystals is contained in a volume percentage of 60 to 90%. It is preferred that the amorphous phase containing quasicrystals be homogeneously dispersed in the crystalline phase and the crystalline phase be present in the network form in such a manner that the crystalline phase substantially surrounds the amorphous phase containing quasicrystals.

BRIEF DESCRIPTION OF THE DRAWING

The single figure is a graph showing a preferred compositional range of additive elements in the present invention.

DETAILED DESCRIPTION OF THE PREFERRED EMBODIMENTS

Many stable amorphous alloys mainly composed of aluminum have been already reported. It is known that these alloys are crystallized at the crystallization temperatures (Tx) inherent in the alloys when heated. The crystallization, however, gives rise to harmful intermetallic compounds simultaneously with the precipitation of an aluminum matrix, which cause the alloys to become brittle. In the present invention, the occurrence of various intermetallic compounds consisting of a principal element and additive elements is limited to a fine dispersion of the intermetallic compounds in the form of quasicrystals in an amorphous phase, and a large amount of particles consisting of an amorphous phase containing quasicrystals are precipitated and dispersed in a crystalline phase consisting of crystals of the principal element and additive elements contained in the form of a supersaturated solid solution. When a molten metal having a suitable composition and produced by homogeneously melt mixing a principal element with additive elements is solidified by rapid cooling, a mixed phase consisting of a crystalline phase in the network form composed of a principal element and additive elements contained in the form of a supersaturated solution, and a fine amorphous phase containing quasicrystals are formed. Although rapid cooling makes it possible to give fine crystal grains and incorporate additive elements in a supersaturated solution form into a matrix, even in a crystalline phase, the alloy of the present invention consists of a mixed phase composed of a crystalline phase and an amorphous phase containing quasicrystals and the volume percentage of the amorphous phase containing quasicrystals is 60 to 90%. Further, the quasicrystal has a grain size of several nanometers or less and is homogeneously dispersed in the amorphous particles. This combined effect is a factor which imparts a high strength to the alloy of the present invention.

In the present invention, the first additive element is at least one element selected from among rare earth elements including yttrium or Mm, and the second additive elements is at least one element selected from among iron, manganese, chromium and vanadium.

A suitable composition consists of aluminum as the principal element and additive elements added in such a manner that the content (y at.%) of the first additive element and that (x at.%) of the second additive element fall within a hatched range in the figure showing the relationship between x and y as defined by lines representing x=0.5, x=8, y=0.5 and y=6, a line formed by connecting a point (x=0, y=6.5) to a point (x=10, y=0) and a line formed by connecting a point (x=0, y=4) to a point (x=7, y=0). A more suitable composition is such that the value of x and y fall within a range covered with dot-dash lines in the figure as defined by lines representing x=3 and x=7, a line formed by connecting a point (x=0, y=5.5) to a point (x=10, y=0) and a line formed by connecting a point (x=0, y=4.5) to a point (x=8.5, y=0).

The contents of the first and second additive elements are preferably within the range defined by $0.5 \leqq x \leqq 8$, $0.5 \leqq y \leqq 6$, $y \leqq -(13/20)x+6.5$ and $y \geqq -(4/7)x+4$. When $y>6$, $x>8$ and $y>-(13/20)x+6.5$, the alloy consists of an amorphous phase or a mixed phase consisting of an amorphous phase and a crystalline phase, but the brittleness is increased and the specific gravity is increased, which does not meet the object of the present invention. Further, when $y<0.5$, $x<0.5$ and $y<-(4/7)x+4$, the alloy cannot comprise any amorphous phase, resulting in a lowering in strength. The first additive elements, i.e., rare earth elements including yttrium and Mm, enhance the capability of forming an amorphous phase and serve to stably maintain the amorphous phase up to a high temperature. Iron, manganese, chromium and vanadium as the second additive elements are present together with the first additive elements and serve to enhance the capability of forming an amorphous phase and, at the same time, supersaturatedly dissolve in the solid solution form in the crystalline phase to enhance the strength of the matrix and bond to aluminum to form quasicrystals. A more suitable range of x and y is one covered with dot-dash lines in the figure ($3 \leqq x \leqq 7$, $y \leqq -(11/20)x+5.5$, $y \geqq -(9/17)x+4.5$). This range is one where the strength of the alloy exceeds 950 MPa by virtue of an interaction of the principal element with the additive elements. The average grain size of the amorphous phase containing quasicrystals homogeneously dispersed in the crystal phase of the alloy of the present invention ranges from 10 to 500 nm.

As described in the claims, the alloy of the present invention has a solute concentration controlled to a lower level than that of the conventional Al-based amorphous alloys. A higher solute concentration than that of the alloy of the present invention is advantageous for the preparation of a more stable amorphous phase. In this case, however, harmful intermetallic compounds formed between the principal element and the additive elements or between the additive elements themselves are apt to precipitate and the resulting material becomes brittle. In the alloy of the present invention, an amorphous phase containing quasicrystals is formed by the decomposition of the amorphous phase due to the solidification by rapid cooling during the preparation of an alloy or the thermal history thereafter, and an aluminum crystal phase (FCC phase) in the network form precipitates so as to surround the periphery of the amorphous phase. Factors which lead to the formation of the quasicrystals mainly reside in the coexistence of aluminum as the principal element and the second additive element, while factors which lead to the formation of the amorphous phase mainly reside in the coexistence of the aluminum, first additive element and second additive element. The feature of the alloy according to the present invention resides in that the average grain size of the amorphous phase containing quasicrystals is adjusted to about 500 nm or less, although it depends upon the kind of the alloy. The quasicrystal is a particle less subject to deformation by virtue of its properties and is a kind of intermetallic compound. The alloy (material) of the present invention is not fragile supposedly because the quasicrystals are homogeneously dispersed in the amorphous phase.

The volume percentage of the amorphous phase containing quasicrystals is limited to 60 to 90%, because when it exceeds 90% in the composition range specified in the present invention, the solute concentration of the amorphous phase will exceed the range in which an intermetallic compound does not crystallize or precipitate while when it is less than 60%, the effect of dispersion strengthening of the fine grains of the amorphous phase is reduced.

The alloy of the present invention can be produced by using a liquid quenching apparatus, for example, a melt spinning apparatus, a high-pressure gas atomizer and other generally known amorphous alloy production means or quenching means. Further, it can be produced by subjecting the amorphous alloy of the present invention produced by using a liquid quenching apparatus to a subsequent heat treatment conducted for the purpose of bulking or forming the alloy.

The present invention will now be described with reference to the following Examples.

EXAMPLE 1

Each of the master alloys having a composition (by atomic percentages) specified in Table 1 was produced in an arc melting furnace and a thin ribbon (thickness: 20 μm, width: 1.5 mm) was produced therefrom by means of a commonly used single roll liquid quench apparatus (a melt spinning apparatus). In this case, the roll was a copper roll with a diameter of 200 mm, the number of revolutions was 4000 rpm, and the atmosphere was argon having a pressure of $10^{-3}$ Torr.

TABLE 1

| Alloy | Volume percentage of amorphous phase (%) | Hardness (DPN) | Strength (MPa) | Elongation (%) | Decomp. temp. (K) |
|---|---|---|---|---|---|
| $Al_{95}Ce_4Mn_1$ | 80 | 355 | 780 | 4.5 | 560 |
| $Al_{93}Ce_3Mn_4$ | 85 | 360 | 1010 | 3.5 | 580 |
| $Al_{92}Ce_2Mn_6$ | 85 | 415 | 1360 | 3.0 | 640 |
| $Al_{96}Mm_2Fe_2$ | 75 | 330 | 870 | 2.5 | 610 |
| $Al_{95}Mm_2Fe_2$ | 75 | 355 | 830 | 2.0 | 600 |
| $Al_{93}Ce_2Fe_5$ | 85 | 420 | 835 | 1.5 | 580 |
| $Al_{93}Ce_4Cr_3$ | 90 | 380 | 1120 | 3.5 | 580 |
| $Al_{95}Ce_2Cr_3$ | 80 | 370 | 1030 | 3.5 | 600 |
| $Al_{92}Ce_2Cr_3Mn_3$ | 85 | 430 | 1210 | 3.0 | 620 |
| $Al_{92}Ce_4Cr_3Co_1$ | 90 | 390 | 1410 | 2.5 | 590 |
| $Al_{92}Mm_2Cr_3V_3$ | 90 | 455 | 1150 | 1.5 | 600 |
| $AI_{92}Mm_2Cr_3V_3$ | 85 | 430 | 1380 | 3.0 | 600 |
| $Al_{93}Mm_1Mn_5Cr_1$ | 85 | 410 | 980 | 2.0 | 580 |
| $Al_{93}Mm_2Mn_3V_2$ | 85 | 420 | 920 | 1.5 | 580 |
| $Al_{95}Y_3Mn_2$ | 85 | 380 | 1020 | 2.0 | 580 |

Each of the thin ribbons thus produced was subjected to a structural analysis according to conventional X-ray diffractometry (with a diffractometer), the measurement of the volume percent of a crystal phase under a transmission electron microscope, the hardness (DPN) with a Vickers microhardness meter (load: 20 g), the strength (MPa) with an Instron type tensile tester and the decomposition temperature (K) of a rapidly cooled phase with a differential scanning thermal analyzer. The results are given in Table 1. According to the results of the X-ray diffractometry, all the thin ribbons had a crystallized phase consisting of an Al phase (FCC phase) alone. The observation under a transmission electron microscope revealed that, in all the thin ribbons, the mean grain size of the amorphous phase containing quasicrystals was 100 nm or less, and an individual amorphous grain were formed of an amorphous phase which contains independent quasicrystals and are surrounded by a crystalline phase (FCC-Al phase) at intervals of the order of nanometer, the volume percentage of the amorphous phase containing quasicrystals being about 80%.

It was confirmed by means of electron beam diffractometry that the amorphous particle contains Al-Mn-based quasicrystals. All the ribbons had a hardness as high as 350 (DPN) or more. All the ribbons exhibited a strength as high as at least 780 MPa. In particular, $Al_{92}Ce_2Mn_6$ had a strength as high as 1360 MPa. Further, the decomposition temperature of the rapidly cooled phase was measured with a differential scanning calorimetry and the results are given in Table 1. The decomposition temperature is the rise temperature of the first peak when the temperature was raised at a rate of 40 K per min. All the thin ribbons exhibited a rise temperature of 500 K or above, that is, they are apparently stable up to high temperatures.

As described above, the materials of the present invention are in such a form that amorphous grains containing fine quasicrystals having a size of 100 nm or less are surrounded by a crystalline phase, and apparently have excellent hardness, strength and thermal stability properties.

EXAMPLE 2

A thin ribbon was produced from each alloy of $Al_{93}Ce_3Mn_4$ and $Al_{92}Mm_2Fe_6$ in the same manner as that of Example 1 and mechanically pulverized to prepare a powder having a size of 10 μm or less. The powder was packed into an aluminum can having an outer diameter of 25 mm, a length of 40 mm and a thickness of 1 mm, deaerated by means of a hot press at a temperature of 523 K under a pressure of 10hu −2 Torr and, pressed at a face pressure of 40 kgf/mm$^2$ to form an extrusion billet. Each billet was heated to 603 K in a heating furnace and extruded at the same temperature and a rate of 20 mm per min (a rate of the extruded material) into an extruded rod having a diameter of 10 mm. The extruded material was worked on a lathe into a tensile test piece having a diameter of 6 mm in the measurement portion and 25 mm in the parallel portion. The test piece was subjected to measurement of its strength at room temperature.

As a result, the tensile strength of the extruded material was 935 MPa for $Al_{93}Ce_3Mn_4$ and 960 MPa for $Al_{92}Mnm_2Fe_6$. The observation of the extruded material under a transmission electron microscope revealed that there was no significant difference in the microstructure between the extruded material and the thin ribbon.

A high-strength aluminum alloy can be produced according to the present invention.

What is claimed is:

1. A high-strength aluminum alloy consisting of an amorphous phase containing quasicrystals and a crystalline phase, said quasicrystals being made up of a first additive element consisting of at least one rare earth element, a second additive element consisting of at least one element selected from the group consisting of iron, manganese, chromium and vanadium and the balance being aluminum, said quasicrystals being homogeneously dispersed in the amorphous phase, said crystalline phase consisting of aluminum, said first additive element and said second additive element in the form of a supersaturated solid solution, said amorphous phase being homogeneously dispersed in said crystalline phase and contained in said aluminum alloy in a volume percentage of 60 to 90%, the content in the alloy in at.% of the first additive element being y and the content in at.% of the second additive element being x, x and y falling within a hatched range in the accompanying figure showing the relationship between x and y as defined by lines representing x=0.5 at.%, x=8 at.%, y=0.5 at.% and y=6 at.%, a line formed by connecting a point (x=0 at.%, y=6.5 at.%) to a point (x=10 at.%, y=0 at.%) and a line formed by connecting a point (x=0 at.%, y=4 at.%) to a point (x=7 at.%, y=0 at.%), said amorphous phase having a particle size of from 10 to 500 nm and said crystalline phase being present in a network form which substantially surrounds the amorphous phase.

2. A high-strength aluminum alloy according to claim 1, wherein said first additive element is at least one element selected from among rare earth elements including yttrium or mischmetal (Mm) and said second additive element is at least one element selected from among iron, manganese, chromium and vanadium.

3. A high-strength aluminum alloy according to claim 1, wherein the values of x and y fall within a range covered with dot-dash lines in the attached figure as defined by lines representing x=3 at.% and x=7 at.%, a line formed by connecting a point (x=0 at.%, y=5.5 at.%) to a point (x=10 at.%, y=0 at.%) and a line formed by connecting a point (x=0 at.%, y=4.5 at.%) to a point (x=8.5 at.%, y=0 at.%).

4. A high-strength aluminum alloy consisting of an amorphous phase containing quasicrystals and a crystalline phase, said quasicrystals being made up of a first additive element consisting of at least one rare earth element, a second additive element consisting of at least one element selected from the group consisting of iron, manganese, chromium and vanadium and the balance being aluminum, said quasicrystals having a grain size of up to several nanometers and being homogeneously dispersed in the amorphous phase, said crystalline phase consisting of aluminum, said first additive element and said second additive element in the form of a supersaturated solid solution, said amorphous phase being homogeneously dispersed in the crystalline phase and contained in said aluminum alloy in a volume percentage of 60 to 90%, the content in the alloy in at.% of the first additive element being y and the content in at.% of the second additive element being x, x and y falling within a hatched range in the accompanying figure showing the relationship between x and y as defined by lines representing x=0.5 at.%, x=8 at.%, y=0.5 at.% and y=6 at.%, a line formed by connecting a point (x=0 at.%, y=6.5 at.%) to a point (x=10 at.%, y=0 at.%) and a line formed by connecting a point (x=0 at.%, y=4 at.%) to a point (x=7 at.%, y=0 at.%), said amorphous phase having a particle size of from 10 to 500 nm and said crystalline phase being present in a network form which substantially surrounds the amorphous phase.

* * * * *

UNITED STATES PATENT AND TRADEMARK OFFICE

CERTIFICATE OF CORRECTION

PATENT NO. : 5 458 700

DATED : October 17, 1995

INVENTOR(S) : Tsuyoshi MASUMOTO, et al

It is certified that error appears in the above-indentified patent and that said Letters Patent is hereby corrected as shown below:

On the title page, item [75] and in Column 1; change "Toshisuke Shitata" to ---Toshisuke Shibata---.

Signed and Sealed this

Seventh Day of May, 1996

Bruce Lehman

*Attest:*

BRUCE LEHMAN

*Attesting Officer*

*Commissioner of Patents and Trademarks*